US006716254B2

(12) United States Patent
Takeuchi

(10) Patent No.: US 6,716,254 B2
(45) Date of Patent: Apr. 6, 2004

(54) MECHANISM THAT SEPARATES A TOP SHEET FROM SHEETS STACKED ON A HOPPER

(75) Inventor: Masaru Takeuchi, Handa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 166 days.

(21) Appl. No.: 09/964,435

(22) Filed: Sep. 28, 2001

(65) Prior Publication Data

US 2002/0070495 A1 Jun. 13, 2002

(30) Foreign Application Priority Data

Dec. 7, 2000 (JP) ..... 2000-373389

(51) Int. Cl.[7] ..... B15H 3/56
(52) U.S. Cl. ..... 271/55; 271/121
(58) Field of Search ..... 271/167, 121

(56) References Cited

U.S. PATENT DOCUMENTS 3,871,641 A * 3/1975 Marx et al. ..... 271/42
4,865,306 A * 9/1989 Himegi ..... 271/121
5,820,121 A * 10/1998 Lan ..... 271/121
5,879,003 A * 3/1999 Kovach et al. ..... 271/121
5,895,040 A 4/1999 Oleksa et al.
5,971,390 A * 10/1999 Caspar et al. ..... 271/121
6,086,062 A * 7/2000 Nakamura et al. ..... 271/121
6,139,007 A 10/2000 Cahill et al.
6,279,897 B1 * 8/2001 Richards ..... 271/121
6,536,757 B2 * 3/2003 Chang ..... 271/16
2002/0163117 A1 * 11/2002 Hsieh ..... 271/121
2003/0038419 A1 * 2/2003 Kawai et al. ..... 271/18

FOREIGN PATENT DOCUMENTS

JP 363071033 * 3/1988 ..... 271/119
JP 403284560 * 12/1991 ..... 271/121

* cited by examiner

*Primary Examiner*—Donald P. Walsh
*Assistant Examiner*—Daniel K Schlak
(74) *Attorney, Agent, or Firm*—Oliff & Berridge, PLC

(57) ABSTRACT

A sheet feeder including a hopper that holds a sheet in a stack, a sheet feed roller that touches the sheet on the hopper and feeds the sheet in a sheet feed direction, a face provided on a front end of the hopper with respect to the sheet feed direction so that a leading edge of the sheet being fed bumps into the face, and a plurality of protrusions that are disposed on the face and that bumps into the leading edge of the sheet when the sheet is fed, wherein protrusions are placed on a plurality of lines parallel to the sheet feed direction, only one of the protrusions is placed on each on of the lines, and each one of the protrusions is separated from each other in a direction perpendicular to the sheet feed direction.

12 Claims, 9 Drawing Sheets

MECHANISM THAT SEPARATES A TOP SHEET FROM SHEETS STACKED ON A HOPPER

BACKGROUND OF THE INVENTION

This application is based on and claims priority under 35 U.S.C. Section 119 with respect to Japanese Patent Application No. 2000-373389 filed on Dec. 7, 2000, the entire content of which is incorporated herein by reference.

1. Field of Invention

The invention relates to a sheet feeder used in an image recording machine such as a printer, a facsimile machine, and a copier. More particularly, the invention pertains to a mechanism that separates a top sheet from sheets stacked on a hopper and feeds one sheet to a process station.

2. Description of Related Art

A known type of a sheet separator is disclosed in U.S. Pat. No. 5,895,040. This sheet separator includes a dam having a plurality of substantially parallel ribs extending from a base surface. One of the ribs is formed from a body of metal having a coating as its exterior surface, which has a low coefficient of friction over which sheets as recording medium move. The body has a longitudinal slot in its exterior surface. An insert, which has a high coefficient of friction with sheets, is supported within the body. The insert is preloaded so that a projection extends a predetermined distance through the slot for engagement with each advancing sheet. The high coefficient of friction of the insert initially engages the advancing edge of the sheet to cause the sheet to buckle or become corrugated. Then the portions of the sheet engage the low coefficient of friction of the exterior surface of the body to separate the sheet from the next adjacent sheet on the stack.

Another known type of a sheet separator is disclosed in U.S. Pat. No. 6,139,007. This sheet separator has slats disposed in the dam. One of the slats is formed with a plurality of protrusions or bumps arranged in a plurality of parallel rows, which are diagonal to the feed direction. According to this sheet separator, only one protrusion at a time engages the sheets to cause the sheets to momentarily buckle and then separate.

SUMMARY OF THE INVENTION

The invention provides an improved sheet feeder of simple structure having a stable sheet separating function and high durability.

Considering the foregoing, one exemplary aspect of the invention involves a sheet feeder including a hopper that holds a sheet in a stack; a sheet feed roller that touches the sheet on the hopper and feeds the sheet in a sheet feed direction; a face provided on a front end of the hopper with respect to the sheet feed direction so that a leading edge of the sheet being fed bumps into the face; and a plurality of protrusions that are disposed on the face and that bumps into the leading edge of the sheet when the sheet is fed, wherein the protrusions are placed on a plurality of lines parallel to the sheet feed direction, only one of the protrusions is placed on each one of the lines, and each one of the protrusions is separated from each other in a direction perpendicular to the sheet feed direction.

According to another exemplary aspect of the invention, the protrusions are arranged so that the leading edge of the sheet bumps into the protrusions at different points when the leading edge of the sheet is moved.

A point of the leading edge of the sheet, at which the sheet slides over a protrusion, does not bump into another protrusion at the downstream position.

BRIEF DESCRIPTION OF THE DRAWINGS

The invention will be described in greater detail with reference to embodiments thereof and the accompanying drawings wherein.

DETAILED DESCRIPTION OF PREFERRED EMBODIMENTS

Figure 1:
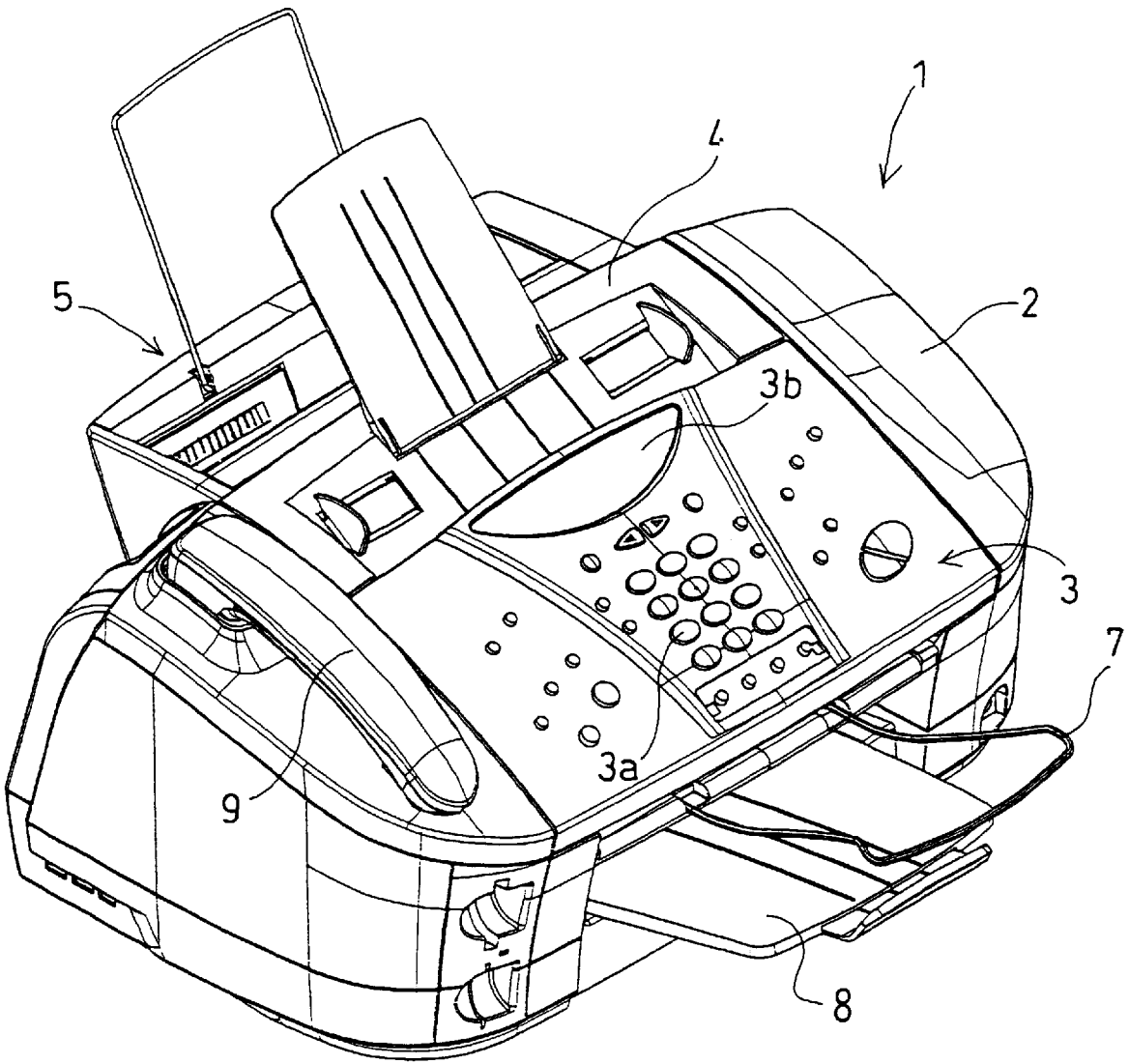
FIG. 1 is a perspective view of a facsimile machine according to an embodiment of the invention.

As shown in FIG. 1, facsimile machine 1 has an operation panel 3 including an input key portion 3*a* and a liquid crystal display 3*b* on a body case 2. A document feed base 4 inclined frontward is provided at the rear of the operation panel 3. A sheet feeder 5 is provided at the rear of the document feed base 4 and includes a hopper 6 to hold sheets P to be fed in a stack. A discharged document supporting member 7 is provided in an upper front part of the front of the body case 2 and holds an original document scanned at a document scanning part (not shown) placed in the body case 2 and discharged therefrom. Below the discharged document supporting member 7, a discharged paper tray 8 is provided where the sheets P printed at a printing station (not shown) are ejected and placed. A handset 9 is placed in an upper left portion of the body case 2. In addition to normal recording sheets such as bond paper, the sheets P may be other media such as envelops, post cards, labels, overhead transparency films, or tracing paper as long as they are thin and capable of forming an image thereon by printing or copying.

Figure 2:
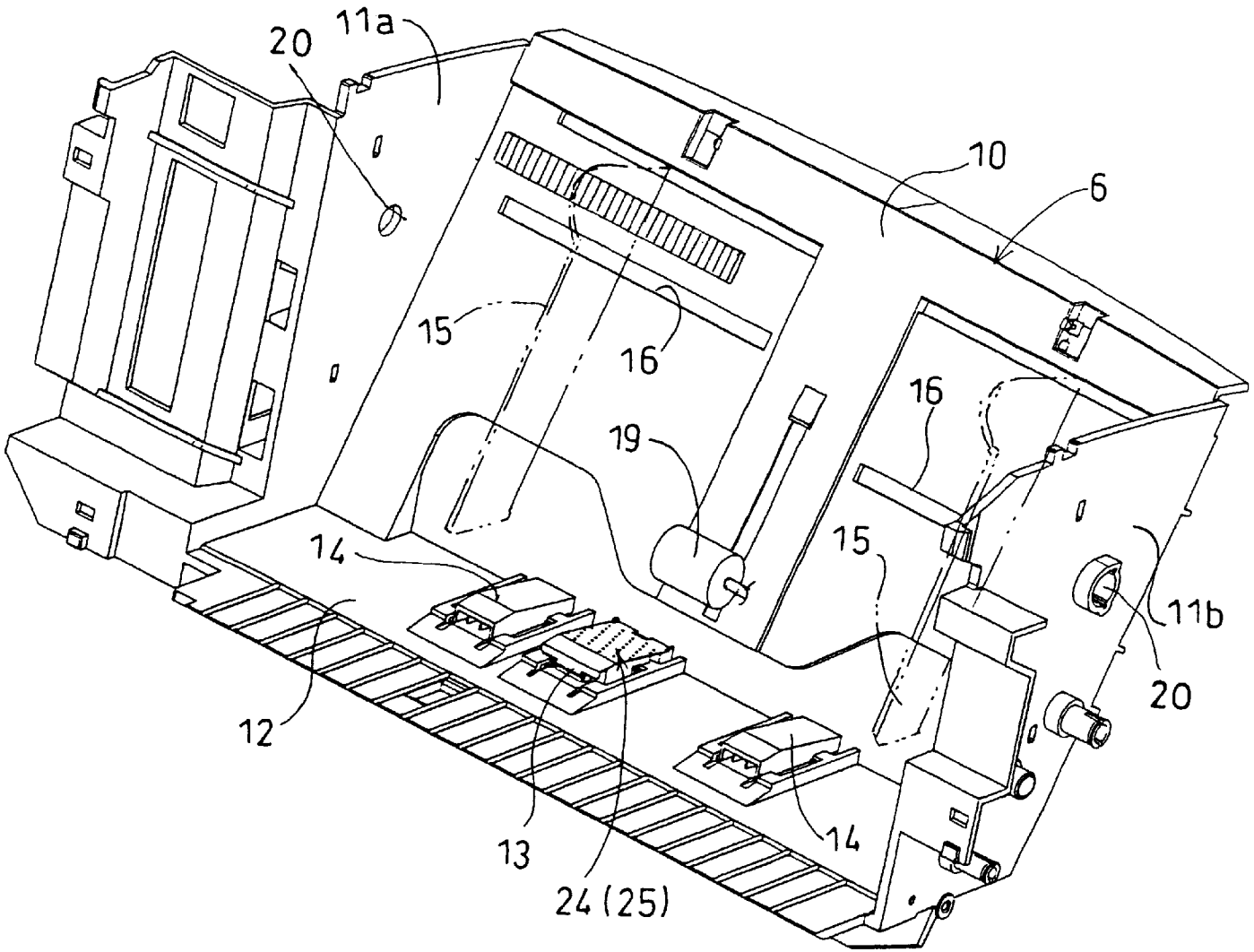
FIG. 2 is a perspective view of a hopper in a sheet feeder.
Figure 3:
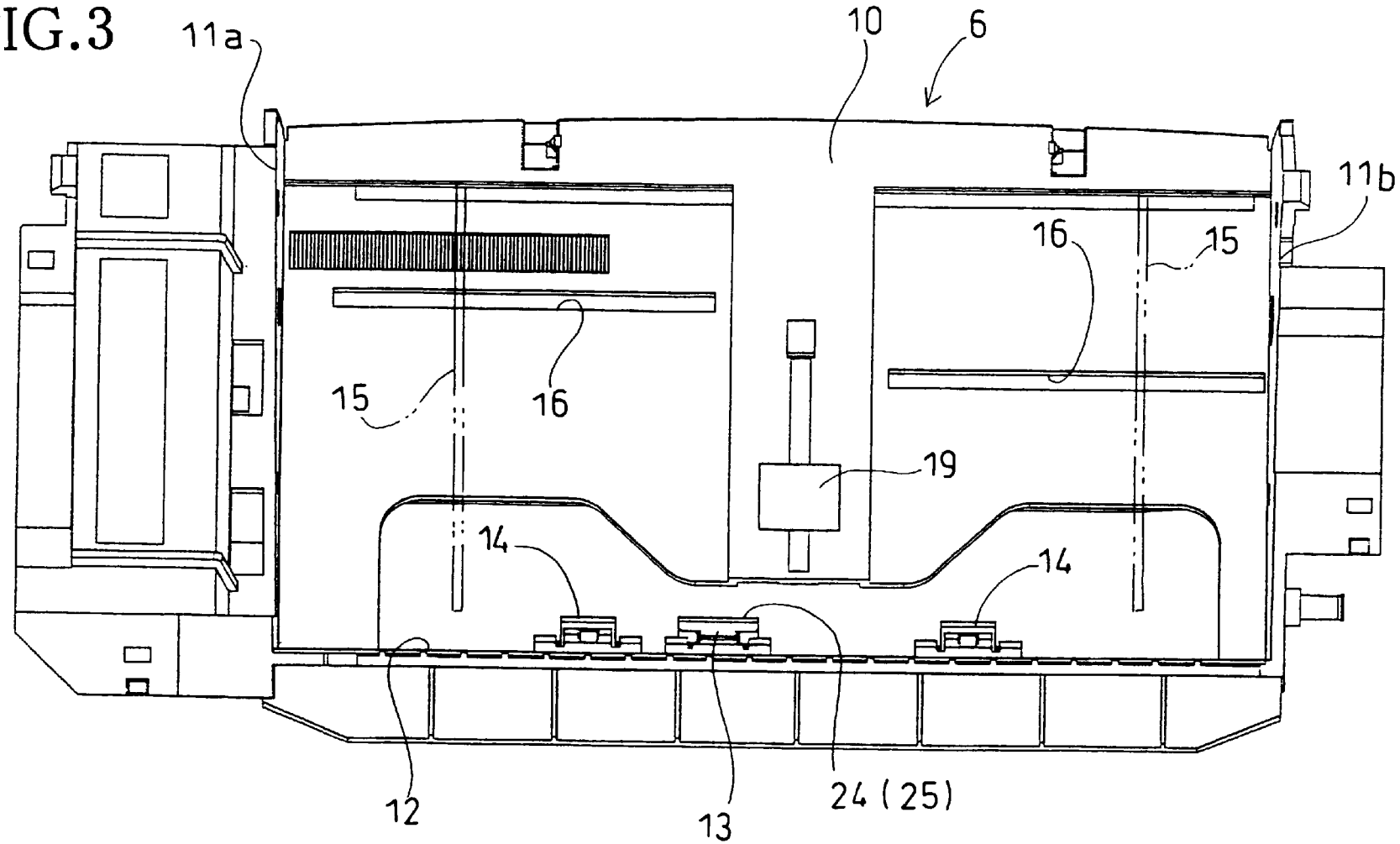
FIG. 3 is a front view of the hopper.
Figure 4:
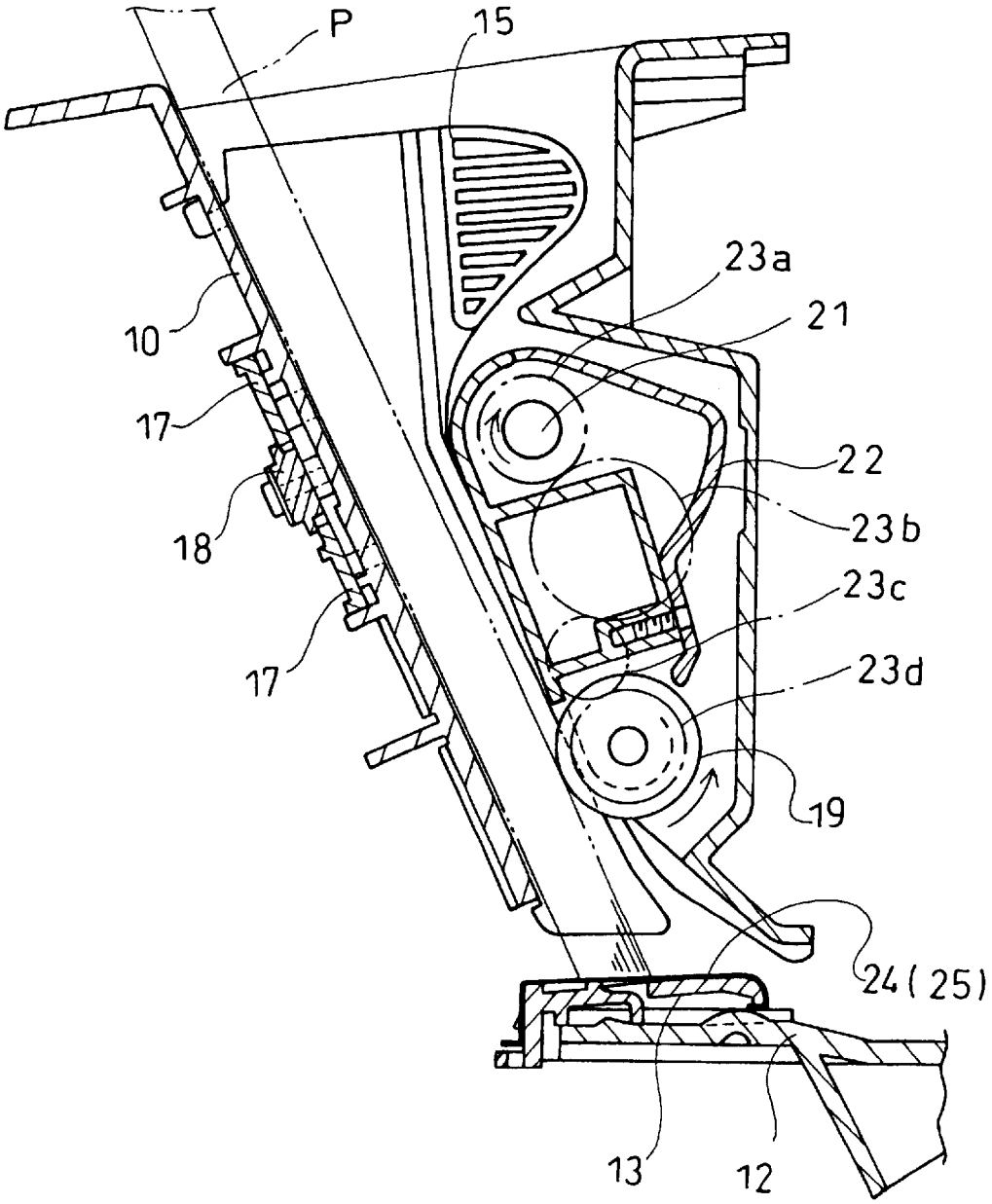
FIG. 4 is a sectional view of main parts of the sheet feeder.

As shown in FIGS. 2 to 4, the hopper 6 of the sheet feeder 5 is integrally formed out of a synthetic resin. A sheet stacker 10 is a flat plate inclined frontward. The sheet stacker 10 is integrally formed with a pair of side plates 11*a*, 11*b* to be fixed to the body case 2 at the opposing ends, and a support plate 12 extending horizontally frontward at a bottom of the sheet stacker 10. A main support member 13 having a working face 24 thereon is disposed at a position corresponding to a substantially center of a width of the sheet on the support plate 12. Auxiliary support members 14, 14 are disposed on both sides of the main support member 13. With this arrangement, as a leading edge of the sheet stacked in the hopper 6 is supported in line at the center and both ends of the leading edge, contact resistance of the sheet can be reduced.

Each of the auxiliary support members 14, 14 is formed as a block made of a synthetic resin with a low coefficient of friction and detachably mounted on the support plate 12. The auxiliary support members 14, 14 are flush with or positioned slightly lower than the main support member 13 (the working face 24). Each of the auxiliary support members 14, 14 has a smooth surface, so that sheets touching the surface can be easily moved.

The working face 24 is inclined upward toward a direction where a sheet is fed to a process station such as a printing part, not shown. The working face 24 is inclined at approximately 6° from a level. A relative angle between the working face 24 and the sheet stacker 10 is obtuse and, in this embodiment, is set to approximately 112°. This facilitates feeding of sheets stacked in the hopper 6 and prevents paper jamming.

Side guide plates 15, 15 for guiding opposing side edges of the sheet are disposed on the surface of the sheet stacker 10. The side plates 15, 15 partially protrude through guide slots 16, 16 formed in the sheet stacker 10, and support racks 17, 17 on the backside of the sheet stacker 10. The racks 17, 17, which are extended sideways and disposed on the backside of the sheet stacker 10, engage a rotatable gear 18. When one of the side guide plates 15 is moved horizontally, the other plate 15 is also moved for the same distance in the opposite direction. Thus, the side guide plates 15, 15 can make contact with side edges of the sheet (FIGS. 2 and 4).

As shown in FIG. 4, the sheet feed roller 19 is disposed in a face-to-face relationship with the sheet stacker 10. A drive shaft 21 is rotatably supported into holes 20, 20 formed in the side plates 11*a,* 11*b* (FIG. 2). A case 22 is movably supported to the drive shaft 21. The sheet feed roller 19, and a plurality of gears 23*a,* 23*b,* 23*c,* 23*d* are disposed inside the case 22. When the drive shaft 21 is rotated clockwise in FIG. 4, the sheet feed roller 19 is designed to be rotated counterclockwise. The case 22 is rotated clockwise in accordance with the drive shaft 21. During sheet feeding operation, the sheet feed roller 19 is designed to rotate in a sheet feed direction while pressing a top sheet of the stack of the sheets P.

The sheet feed roller 19 is approximately 17 mm in diameter and approximately 20 mm in width in this embodiment. The sheet feed roller 19 is positioned in such a manner that a peripheral surface of the sheet feed roller 19 touching a top sheet of the sheets P stacked on the sheet stacker 10 is approximately 25–27 mm away from the working face 24 with the sheets P in portrait orientation set on their leading edges at the working face 24.

Figure 5A:
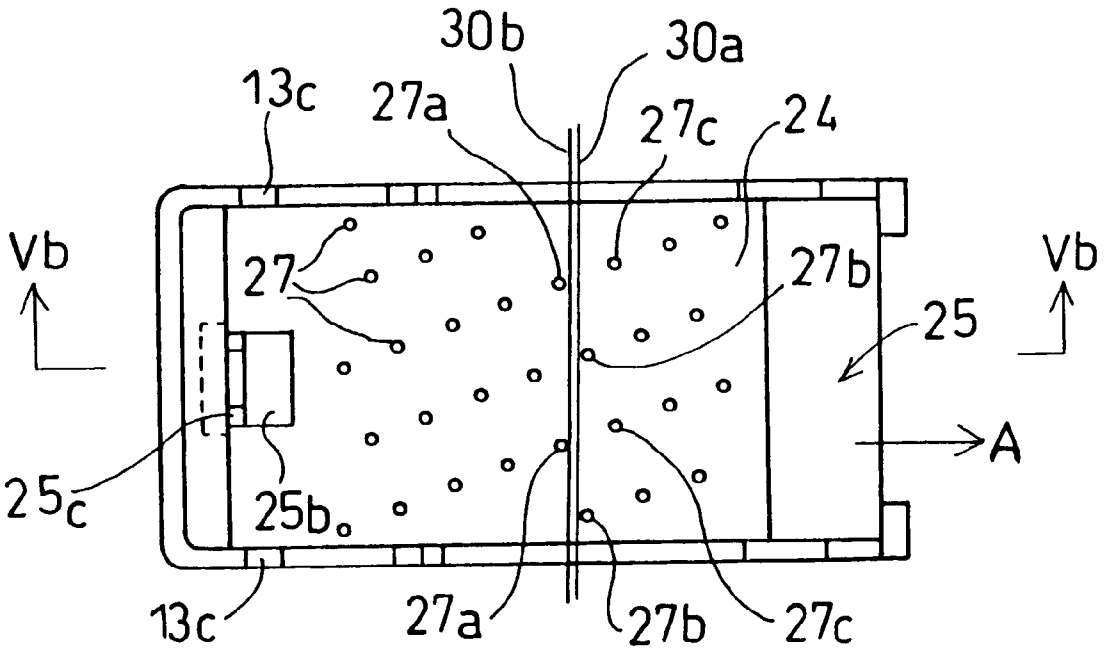
FIG. 5A is a plan view of a working face and a main support member.
Figure 5B:
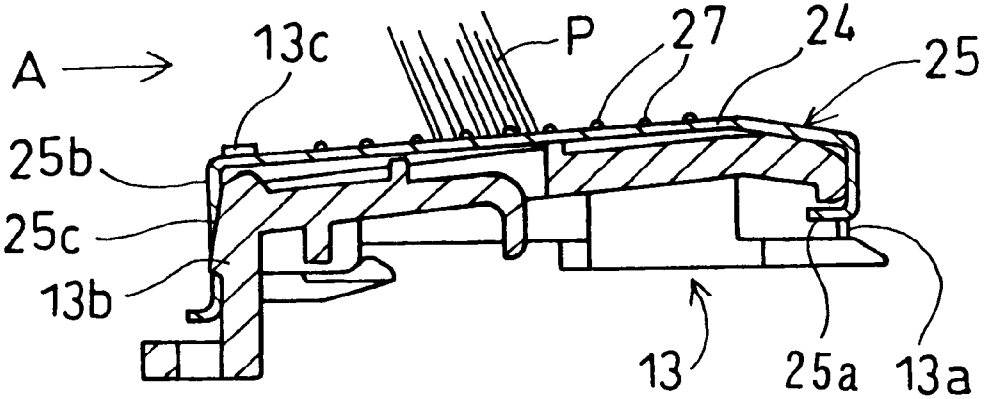
FIG. 5B is a sectional view taken along line Vb—Vb of FIG. 5A.
Figure 6:
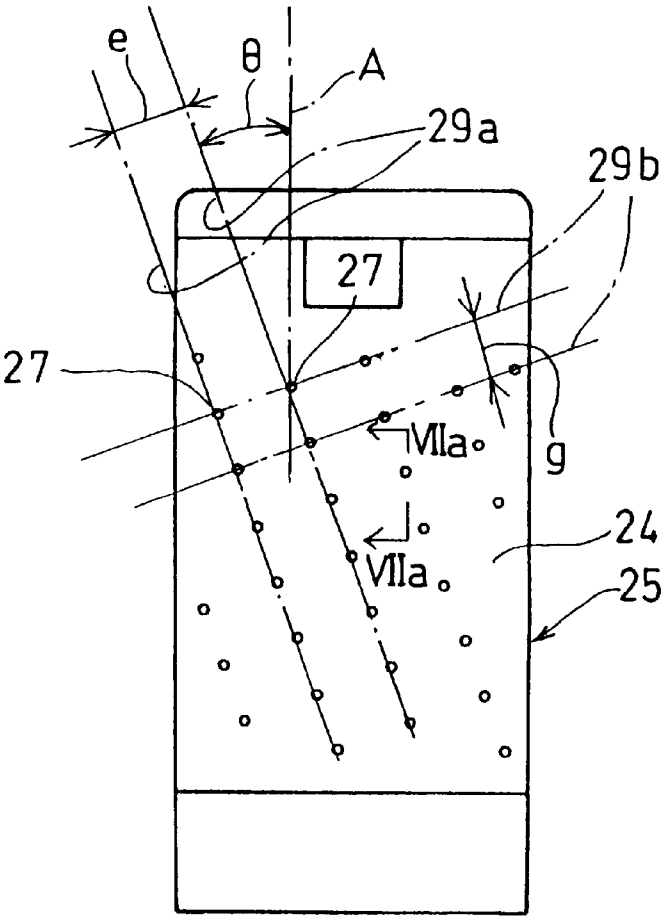
FIG. 6 is a plan view showing an arrangement of protrusions.

With reference to FIGS. 2, 5A, 5B and 6, the working face 24 and the main support member 13 will be described. The main support member 13 is a block made of a synthetic resin and a bottom of the main support member 13 is detachably mounted on the support plate 12. A plate 25 having the working face 24 is a metallic plate such as a stainless plate or a phosphor bronze plate, and detachably mounted on the main support member 13. As shown in FIGS. 5A, 5B and 6, the plate 25 is a substantially rectangle in plan view. An engagement hook 25*a,* which is formed at one end of the plate 25 is C-shape in cross section, engages a hole 13*a,* opened at one end of the main support member 13. A segment 25*b* formed at the other end of the plate 25 has a hole 25*c* in the center thereof and is structured so that a hook 13*b* formed at the other end of the main support member 13 engages in the hole 25*c*. Segments 13*c,* 13*c* are formed integral with the main support member 13. The segments 13*c,* 13*c* project from both sides of the main support member 13, and make contact with both sides of the plate 25 with respect to the width of the sheet to fix the plate 25 into the mounting position.

A plurality of protrusions 27 formed on the working face 24 will be described. The protrusions 27 are integrally formed on the working face 24 by pressing the plate 25 of metal by plates having protrusions and dimples (recesses) of a shape corresponding to the protrusions 27. Therefore, the manufacturing cost can be greatly reduced. Both the working face 24 and the protrusions 27 are superior in durability because they are made of metal, and less subject to fluctuations in height and shape of the protrusions due to temperature variations because of integral formation. Thus, the separation of the sheets is stabilized.

An arrangement of the protrusions 27 of a first embodiment will be described with reference to FIGS. 5A and 6. In plan view, each protrusion 27 is disposed on one of a plurality of points where first lines 29*a* and second lines 29*b* intersect, the first lines 29*a* being inclined at an angle θ (20° in this embodiment) with respect to a sheet feed direction (shown by arrow A) and the second lines 29*b* being orthogonal to the first lines 29*a*. A spacing e between the protrusions 27 is approximately 4 mm on the first line 29*a* and a spacing g is approximately 3 mm on the second line 29*b*. The working face 24 has the protrusions 27 thereon into which the leading edge of the sheet bumps when the leading edge of the sheet is moved. The protrusions 27 are arranged separately from each other with respect to the leading edge of the sheet so as not to continuously hit a same point of the leading edge of the sheet when the leading edge of the sheet is moved. Further protrusions 27 placed on a plurality of lines parallel to the sheet feed direction (arrow A), only one of the protrusions 27 is placed on each one the lines, and each one of the protrusions 27 is separated from each other in the direction perpendicular to the sheet feed direction. A downstream protrusion 27 of the sheet feed direction is arranged at a predetermined length away from an upstream protrusion in the direction perpendicular to the sheet feed direction.

Figure 7A:
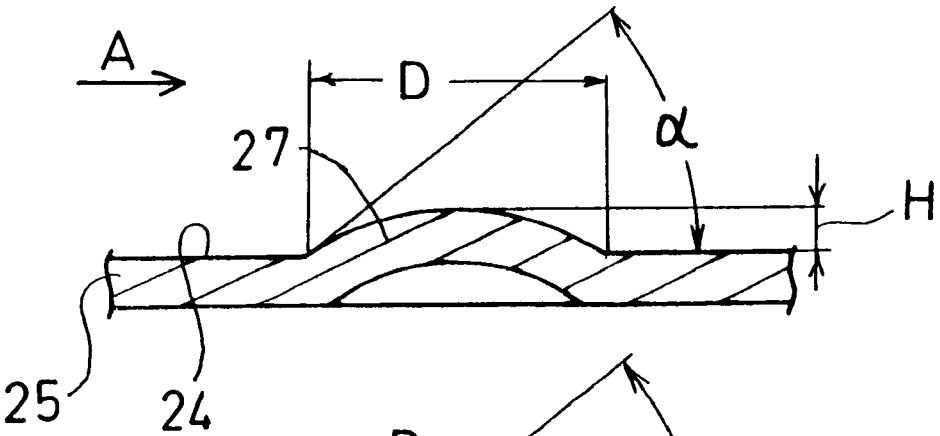
FIG. 7A is an enlarged sectional side view of a protrusion taken along line VIIa—VIIa of FIG. 6.
Figure 7B:
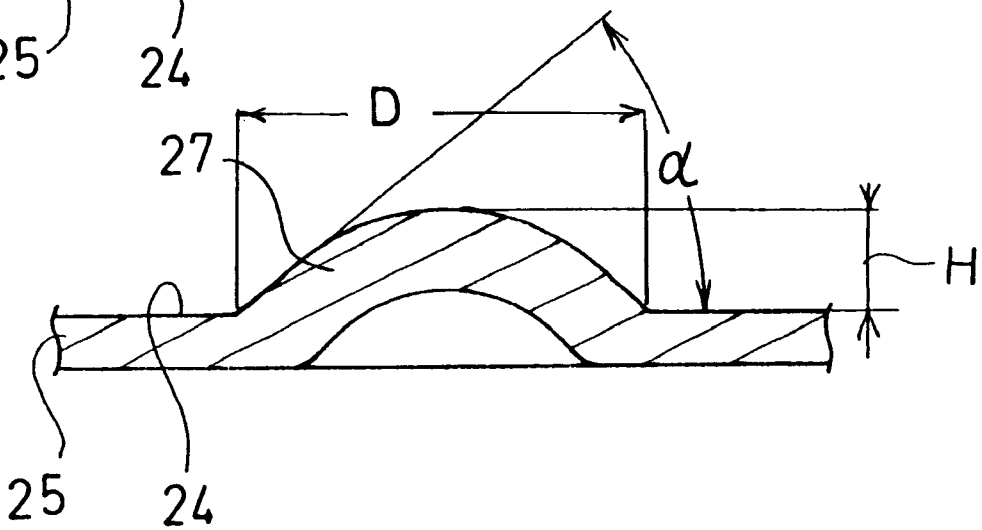
FIG. 7B is an enlarged sectional side view of another protrusion.

As shown in FIGS. 7A, 7B, an angle α of each protrusion 27 rising up from the working face 24 is an acute angle and set to 40° in the embodiment. The angle α refers to an angle of a side where the leading edge of the sheet slides up onto the protrusion 27 from the working face 24 when the leading edge is moved. An angle on a side where the leading edge slides down from the protrusion 27 to the working face 24 may be a right angle or an obtuse angle. Each protrusion 27 can be shaped into a convex or a straight line on a side where they rise from the working face 24. Further, it is preferable that the shape of each of the protrusions 27 is convex at a top, but may be flat.

As the angle α of each protrusion 27 is acute, the leading edge of a sheet can smoothly slide on a protrusion 27 from the working face 24, and the sheets P can be also separated smoothly.

Each of the protrusions 27 shown in FIGS. 7A and 7B is 0.6 mm in diameter and 0.12 mm in height in this embodiment.

The operation of sheet feeding in the above arrangement will be described. The leading edge of each of the sheets P stacked on the sheet stacker 10 is supported by the plate 25 of the main support member 13 and the auxiliary support members 14, 14 (FIG. 4). Of the sheets P, for example, a part of a leading edge 30*a* of a top sheet and a part of a leading edge 30*b* of the adjacent lower sheet make contact with the working face 24 between the two protrusions 27*b*, 27*b* aligned along the sheet width and downstream toward the feed direction (shown by arrow A) with the two protrusions 27*a*, 27*a* aligned along the sheet width and upstream from the protrusions 27*b*, 27*b* as shown in FIGS. 5A, 5B.

As the front side of the working face 24 is inclined at approximately 6° to a level, the leading edge of each of the sheets P bumping into the working face 24 is efficiently restrained so that the leading edge does not move upstream beyond the protrusions 27*a*, 27*a*.

With this condition, when the sheet feed roller 19 is rotated in a predetermined direction based on a printing order, the leading edge 30*a* of the top sheet, abutting on the peripheral surface of the sheet feed roller 19, is fed in the feed direction shown by arrow A by a frictional force with the peripheral surface of the sheet feed roller 19. At this time, the leading edge 30*a* of the top sheet slides up and over the protrusions 27*b*, 27*b*. However, as the frictional force with the sheet feed roller 19 does not act on the adjacent sheet, the leading edge 30*b* of the adjacent sheet is blocked at the protrusions 27*b*, 27*b* and remains there. When the leading edge 30*a* of the top sheet slides up over the protrusions 27*b*, 27*b*, only the top sheet is bent round in the vicinity of the leading edge 30*a* to provide a space between the top sheet and the adjacent sheet. Thereby, the top sheet is separated from the adjacent sheet and fed to the process station such as a printing part. When the leading edge 30*a* of the top sheet is advanced over the protrusions 27*b*, 27*b*, depressions substantially equal to the shapes of the protrusions 27*b* in cross section are left on the leading edge 30*a*.

In the unlikely event that the top sheet and the adjacent lower sheet are simultaneously fed (double feeding), the leading edges 30*a*, 30*b* continuously slide over the protrusions 27*b*, 27*b*, such depressions are left on the same places on the leading edges 30*a*, 30*b*. When the sheet feed roller 19 is further rotated to feed the top sheet in the direction shown by arrow A, the leading edge 30*a* bumps into protrusions 27*c*, 27*c* located downstream from the protrusions 27*b*, 27*b* and is about to slide over the protrusions 27*c*, 27*c*. At this time, the protrusions 27*c*, 27*c* are laterally shifted by an amount $g \times \sin\theta + e \times \cos\theta$ from the protrusions 27*b*, 27*b* with respect to the sheet width. Therefore, the leading edge 30*a* of the top sheet bumps into the protrusions 27*c*, 27*c*, at different positions from the depressions already formed thereon by the protrusions 27*b*, 27*b*. When the leading edge 30*a* slides over the protrusions 27*c*, 27*c*, the top sheet can be separated from the adjacent sheet, thereby ensuring only one sheet is separated from the stack of the sheets P and fed to the process station and preventing double feeding from occurring. In this case, four depressions are left on the leading edge 30*a* of the top sheet.

Similarly, when the adjacent lower sheet coming uppermost is fed by the sheet feed roller 19, the leading edge 30*b* of the adjacent lower sheet bumps into and slides over the protrusions 27*c*, 27*c* at different positions from where the depressions have been made at the leading edge.

Figure 8B:
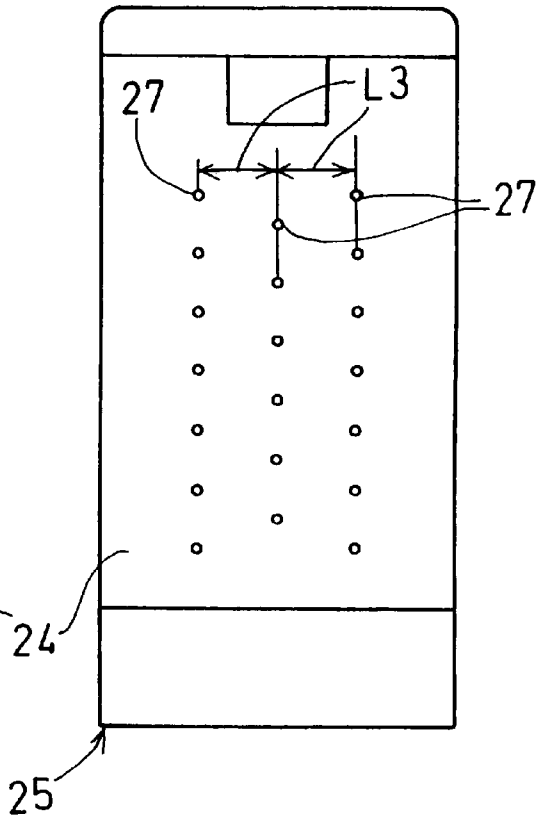
FIG. 8B is a plan view showing an arrangement of the protrusions according to a third embodiment of the invention.
Figure 8A:
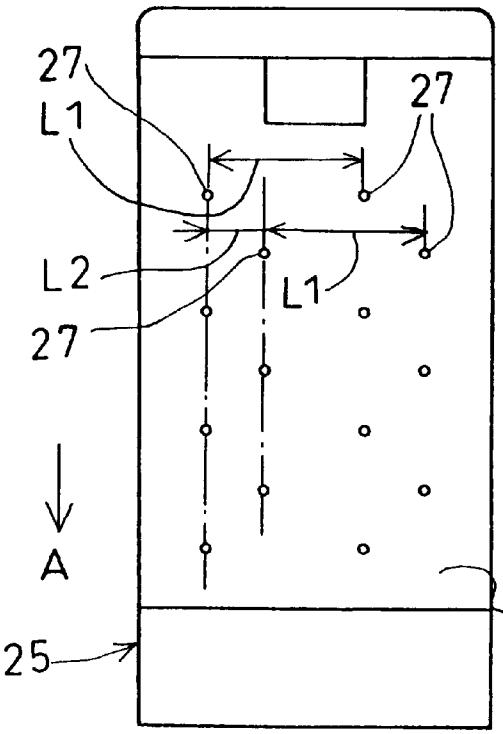
FIG. 8A is a plan view showing an arrangement of the protrusions according to a second embodiment of the invention.

In a second embodiment shown in FIG. 8A, a set of two protrusions 27, which are apart from each other by length L1, is arranged in a plurality of parallel rows along the sheet width. Each set of the two protrusions 27 is alternately staggered by length L2 (L2<L1) among the rows. Therefore, the depressions on the leading edge of each of the sheets P are made in two different ways, one by the protrusions in the odd-numbered rows and the other by the protrusions in the even-numbered rows.

In a third embodiment shown in FIG. 8B, two protrusions 27, 27 are disposed by a length 2×L3 away from each other in odd-numbered rows along the feed direction (shown by arrow A), and a single protrusion 27 is disposed in the middle of the two protrusions 27, 27 in even-numbered rows.

Thus, in the second and third embodiments, it is ensured that the each protrusion does not continuously bump into the leading edge of the sheet at a particular point when the sheet is advanced. When the leading edge 30*a* of the top sheet and the leading edge 30*b* of the adjacent sheet continuously slide over the protrusions and the top sheet and the adjacent sheet are simultaneously fed (double feeding), the sheet feed roller 19 is further rotated to feed the top sheet, so that the leading edge 30*a* of the top sheet bumps into the downstream protrusions at a position different from the positions where the depressions have already formed at the leading edge. When the leading edge 30*a* of the top sheet slides over the downstream protrusions, the top sheet is separated from the adjacent sheet, thereby ensuring only one sheet is separated from the stack of the sheets and preventing double feeding from occurring.

Figure 9A:
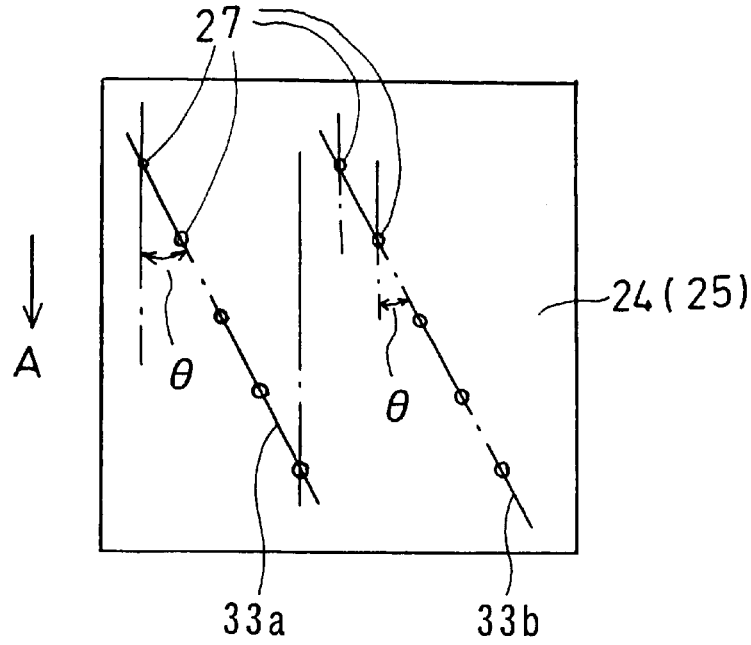
FIG. 9A is a plan view showing an arrangement of the protrusions according to a fourth embodiment of the invention.
Figure 9B:
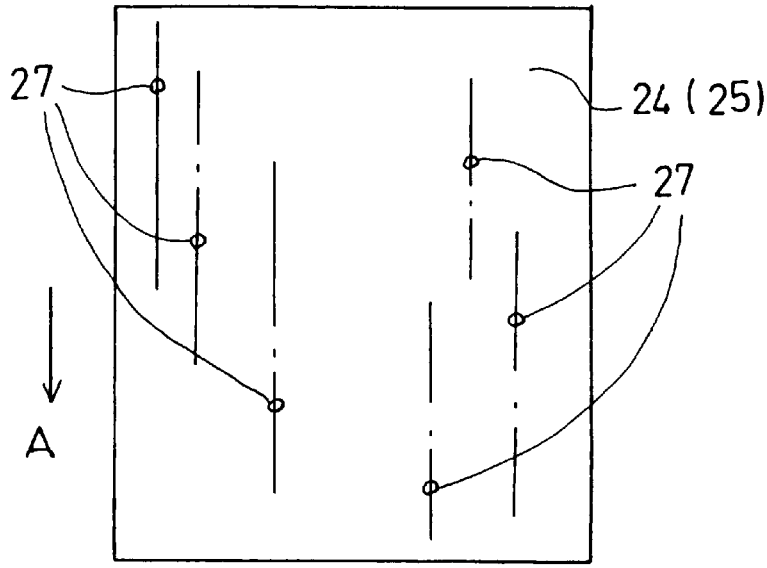
FIG. 9B is a plan view showing an arrangement of the protrusions according to a fifth embodiment of the invention.

In FIGS. 9A and 9B, the protrusions 27 are arranged in such a manner that each of the protrusions 27 hits the leading edge of the sheet at a particular point at a time when the sheet is advanced.

In a fourth embodiment shown in FIG. 9A, on the working face 24 in plan view, two parallel lines 33*a*, 33*b* inclining at an angle θ (approximately 30° in this embodiment) with respect to the feed direction (shown by arrow A) are disposed greatly apart from each other with respect to the sheet width. The protrusions 27 are formed at established intervals on each line.

In a fifth embodiment shown in FIG. 9B, the protrusions 27 are disposed at random on the working face 24 in plan view, however, each protrusion 27 bumps into the leading edge at a particular point in time.

In the fourth and fifth embodiments, the leading edge of the sheet does not bump into the downstream protrusions at the depressions on the leading edge. If the sheet separation fails at upstream protrusions, the sheet separation can be performed at the downstream protrusions, thereby preventing double feeding from occurring.

In each embodiment, the working face 24 with the protrusions 27 is disposed only on the main support member 13, which is located to make contact with substantially the center of the width of the sheets P, and is not formed on the auxiliary support members 14, 14, which are respectively disposed to make contact with both ends of the width of the sheets P. The working face 24 is designed to make contact with a part of the leading edge of the sheet and the protrusions 27 are arranged on the working face 24. Therefore, the working face 24 can be compact in size.

As a modified example, the working face 24 can be lengthened laterally as long as the sheet width. This laterally long working face facilitates adjustment for supporting the leading edge of a sheet horizontally in line compared with a case where the main support member 13 and the auxiliary support members 14, 14 are provided separately. It is preferable that the protrusions 27 are provided on at least one part of the laterally long working face. If the protrusions 27 are formed on the entire laterally long working face, resistance to the leading edge of the sheet becomes excessively great when the sheet is advanced, thus spoiling smooth sheet feeding.

Instead of providing auxiliary support members 14, 14 as discrete parts, an auxiliary support surface may be formed from the support plate 12 by upwardly raising both ends of the support plate 12, being flush with or positioned slightly lower than the working face 24 provided on the main support member 13. Further, integrally with the support plate 12, the auxiliary support members 14, 14 and the main support member 13 can be formed extending along the sheet width. The plate 25 having the working face 24 is attached to a part of this integral formation with respect to the sheet width.

In the above embodiments, the sheet feed roller 19 is placed substantially at a center with respect to the sheet width. The working face 24 with the protrusions 27 is placed slightly shifted from the sheet feed roller 19 (FIG. 3). As a force acting on a sheet by the sheet feed roller 19 is not directly applied to the working face 24, the sheet is easily bent when it is separated from the stack of the sheets P. However, if the protrusions 27 are disposed in such a manner to make contact with one end of the sheet with respect to the sheet width, the sheet is excessively bent when the leading edge of the sheet bumps into the protrusions, and the sheet is resultantly fed on the skew. Therefore, it is preferable that one or two groups of protrusions are disposed to make contact with the center of the sheet with respect to the sheet width as much as possible.

In the above embodiments, the hopper 6 is disposed with a slant and the working face 24 is formed at a lower end of the hopper 6. Thus, sheets P in portrait orientation are set on their edges in an image recording apparatus such as a facsimile machine, and the depth dimension of the image recording apparatus can be reduced. The hopper 6 may be disposed substantially horizontally and the working face 24 may be inclined at a front end of the hopper 6.

It should be understood that the invention is not limited in its application to the details of structure and arrangement of parts illustrated in the accompanying drawings. The invention is capable of other embodiments and of being practiced or performed in various ways without departing from the technical idea thereof, based on existing and well-known techniques among those skilled in the art.

What is claimed is:

1. A sheet feeder, comprising:

a hopper that holds a sheet in a stack;

a sheet feed roller that touches the sheet on the hopper and feeds the sheet in a sheet feed direction;

a face provided on a front end of the hopper with respect to the sheet feed direction so that a leading edge of the sheet being fed bumps into the face; and a plurality of protrusions disposed on the face and that bumps into the leading edge of the sheet when the sheet is fed, wherein the protrusions are placed on a plurality of lines parallel to the sheet feed direction, only one of the protrusions is placed on each one of the lines, and each one of the protrusions is separated from each other in a direction perpendicular to the sheet feed direction.

2. The sheet feeder according to claim 1, wherein a downstream protrusion in the sheet feed direction is arranged at a predetermined length away from an upstream protrusion in the direction perpendicular to the sheet feed direction.

3. The sheet feeder according to claim 2, wherein the protrusions are arranged to bump into a part of the leading edge of the sheet.

4. The sheet feeder according to claim 3, wherein the face is provided to bump into a part of the leading edge of the sheet.

5. The sheet feeder according to claim 4, further comprising an auxiliary support face that supports one end of the leading edge of the sheet, wherein the face having the protrusions is placed in an approximate center of the leading edge.

6. The sheet feeder according to claim 2, wherein an angle formed between the face and a tangent to the protrusion in a point on a borderline between the face and the protrusion is about 40 degrees.

7. The sheet feeder according to claim 2, wherein the face and the protrusions are integrally formed with a metallic material.

8. The sheet feeder according to claim 2, wherein the face is placed at an obtuse angle with respect to a front end of the hopper.

9. The sheet feeder according to claim 2, wherein the face is inclined upward toward the sheet feed direction at an acute angle with respect to a level surface.

10. The sheet feeder according to claim 1, wherein each of the protrusions is disposed on one of a plurality of points where first lines and second lines intersect, the first lines being inclined at an angle $\theta$ with respect to the sheet feed direction and the second lines being orthogonal to the first lines.

11. The sheet feeder according to claim 1, wherein the protrusions are arranged at predetermined intervals in two straight lines each having a predetermined angle $\theta$ with respect to the sheet feed direction, which are apart from each other with respect to a width of the sheet.

12. The sheet feeder according to claim 1, wherein a number of protrusions placed on a plurality of lines perpendicular to the sheet feed direction is less than three.

* * * * *